United States Patent [19]

Smith

[11] 4,197,780

[45] Apr. 15, 1980

[54] METHOD AND APPARATUS FOR STABILIZING THE TENSION OF MUSICAL INSTRUMENT STRINGS

[76] Inventor: Richard M. Smith, 2212 Witchwood La., Lindenhurst, Ill. 60046

[21] Appl. No.: 1,180

[22] Filed: Jan. 5, 1979

[51] Int. Cl.[2] ..... G10G 7/00

[52] U.S. Cl. ..... 84/458; 84/453

[58] Field of Search ..... 84/453, 454, 455, 458; 140/123, 123.5

[56] References Cited

U.S. PATENT DOCUMENTS

| | | | |
|---|---|---|---|
| 881,269 | 3/1908 | Van Houten | 84/454 |
| 4,112,808 | 9/1978 | Ketterer | 84/453 |

*Primary Examiner*—Lawrence R. Franklin

*Attorney, Agent, or Firm*—Trexler, Wolters, Bushnell & Fosse, Ltd.

[57] ABSTRACT

An apparatus and method are disclosed for inducing pitch stability in musical strings. A tensioned string is placed in a frictioning channel provided in the apparatus; and the apparatus is then caused to traverse the length of the string repeatedly to maximize the string elongation and tensional stability.

5 Claims, 4 Drawing Figures

METHOD AND APPARATUS FOR STABILIZING THE TENSION OF MUSICAL INSTRUMENT STRINGS

BACKGROUND OF THE INVENTION

This invention relates to an apparatus and method for stabilizing the tension of musical strings.

As is well known, the tension of a musical instrument string requires a considerable period of time to stabilize after the string is first brought to proper pitch on the musical instrument. This is especially true where the desired pitch is obtained at a relatively low operative tension as is generally found on guitars and the like.

When a new string is installed on a guitar, one end of the string is first anchored to the tailpiece or bridge of the instrument by suitable means with the string spanning the sounding board. The other end of the string is attached to a tuning peg by which the tension of the string is increased until the desired musical pitch is obtained.

Due to the tendency of the string to yield under the newly-induced tension, the instrument may not be properly played until the tension and resultant pitch are stabilized through relaxation and subsequent re-tightening. However, since new strings have a desirable tonal brilliance, many performers would prefer to put new strings on their instruments prior to a performance if immediate pitch stability could be obtained. In addition, when a new string is installed during performance to replace one which has broken, immediate pitch stability is necessary to allow the instrument to be properly played.

Thus, it has long been a desideratum among instrumentalists to stabilize the pitch of a newly installed musical string as quickly as possible.

It has generally been the custom of performers to attempt to induce pitch stability by manually pulling the string away from the instrument in a direction perpendicular to the axis of the string. This method is ineffective in that the stretching force is inadequate to effect complete tensional stability. Moreover, as the instrument is designed to withstand only shear force from the strings, the tensional force resulting from pulling or lifting a string above its axis can adversely affect the structural integrity of the instrument. Furthermore, with strings of exceptionally light gauge, sufficient stretching force can result in discomfort or injury to the performer.

U.S. Pat. No. 881,269 granted to Van Houten teaches the use of a small roller placed under the string for use in drawing the string upward and away from the body of the instrument. This device does not overcome the disadvantages discussed above, because it subjects the instrument to vectors of force that it was not designed to withstand. In addition, the use of a small roller can easily cause permanent deformation or bending of the string; and this may substantially affect its strength and tonal quality.

It is thus an object of the present invention to provide an apparatus and a method of quickly stabilizing the tension of a musical string without the use of forces that may damage the string or the musical instrument. Other objects and advantages of the invention will become apparent upon reading the following detailed description and upon reference to the drawings in which.

DETAILED DESCRIPTION OF THE ILLUSTRATED EMBODIMENT

Figure 1:
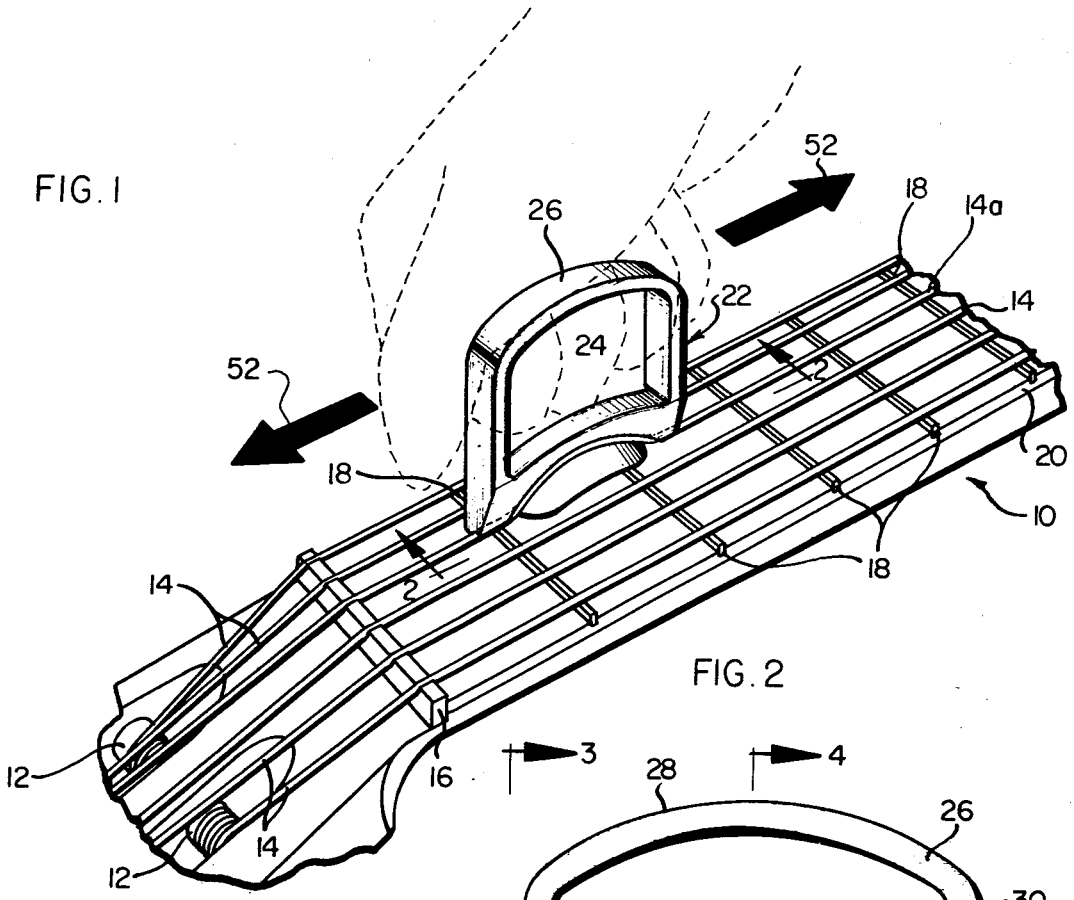
FIG. 1 is a perspective view showing the apparatus of the present invention operatively in place on the neck of a guitar.

Referring now in detail to the drawings, specifically to FIG. 1, a portion of a guitar neck 10 is illustrated. The guitar neck 10 is fitted with a plurality of rotatable tuning pegs 12 disposed on that end of the guitar neck 10 which is opposite the body portion or sounding box of the guitar. The tuning pegs 12 are used to vary the tension of a plurality of strings 14 each of which may produce musical notes by vibrating between the guitar bridge, not shown, and a string guide or nut 16. In the course of performance the artist manually causes one or more of the strings 14 to bear against the frets 18 transversely disposed in a finger board 20 to control the vibrating length of the string and hence its pitch.

Figure 2:
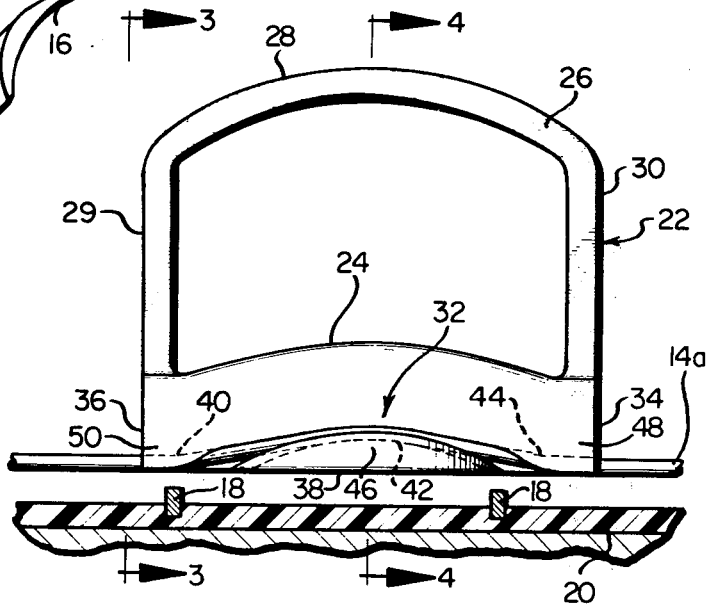
FIG. 2 is an enlarged sectional view taken in side elevation and showing the instant tension stabilizing apparatus viewed along the plane of line 2—2 of FIG. 1.

In FIG. 1, one of the guitar strings 14*a* is shown fitted with a tension stabilizer 22 constructed in accordance with the present invention. The stabilizer 22 is advantageously constructed of a moldable resinous material such as high density polyethylene, and is seen to comprise an elongate body portion 24 and a handle portion 26 attached thereto. Referring to FIG. 2, the handle portion 26 is seen to comprise a manually grippable arcuate member 28 spaced a suitable distance from body portion 24 and connected thereto by end arms 29 and 30.

The stabilizer 22 is constructed with a relatively thin overall transverse dimension to facilitate attachment to the inside strings as shown in FIG. 1. When installed on a string, the stabilizer 22 has sufficient clearance above the frets 18 and the finger board 20 to permit the movement of the stabilizer 22 along the string without interference.

As shown in FIG. 2, the body portion 24 includes a frictioning channel 32. The channel courses through end sections 34 and 36 and a mediate element 38 of the body portion 24. Channel 32 is fashioned with relatively long radii of curvature so as to cause the string 14*a* to bear against the end sections 34 and 36 and mediate element 38 without permanently deforming the string or otherwise affecting the tonal quality thereof.

Figure 3:
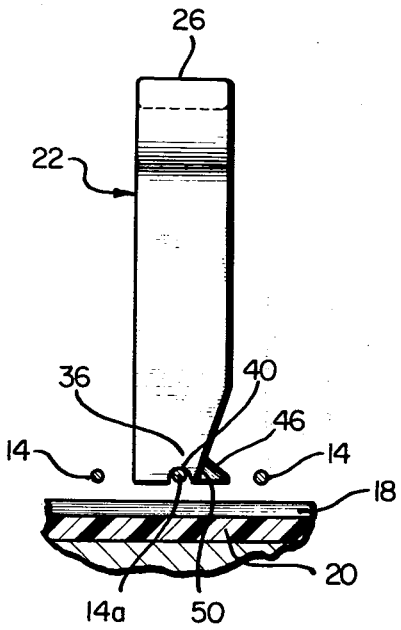
FIG. 3 is an enlarged sectional view in end elevation taken substantially in the plane of line 3—3 of FIG. 2.
Figure 4:
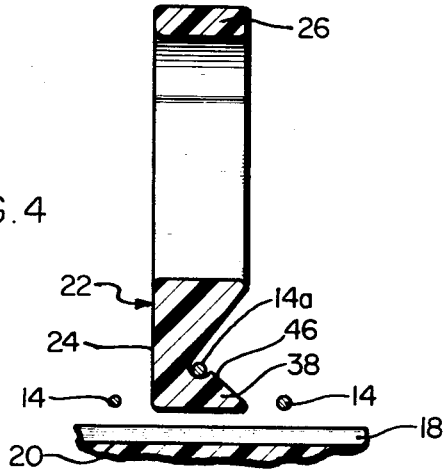
FIG. 4 is a view similar to FIG. 3 but taken substantially in the plane of line 4—4 of FIG. 2.

In the practice of the novel method herein described, the string 14*a* is first placed in a lipped groove 40 of the leading end section 34. The string 14*a* is then manipulated into a lipped groove 42 of the mediate element 38 and through a lipped groove 44 of the following end section 36, the lipped grooves being shown by phantom lines in FIG. 2. As is shown in FIGS. 3 and 4, the lipped grooves 40, 42 and 44 are semi-circular in cross section having a diameter greater than any of strings 14. Each of said grooves is positioned to restrict the lateral displacement of the string 14*a* and retain the string in a bearing relationship against the end sections 34 and 36 and the mediate element 38, which cooperate to define the frictioning channel 32.

The mediate element 38 is provided with a beveled side portion 46 and the end sections 34 and 36 include beveled side portions 48 and 50 to facilitate the placement of the string 14*a* in the lipped grooves 40, 42 and 44.

The installer then grasps handle portion 26 and slides stabilizer 22 several times along the total sounding length of string 14*a*. This sliding movement, suggested by arrows 52, creates an increased tension along string 14*a* aft of and a decreased tension forward of stabilizer 22 due to the frictioning effect of channel 32. Thus, as stabilizer 22 is moved back and forth along the string 14*a*, said string is subjected to repeated uniform fluctuations of tension along its entire sounding length.

In addition, as string 14*a* is drawn through frictioning channel 32 the friction and directional changes provided by end sections 34 and 36 and mediate element 38 accomplish a cold working effect on the string. The cold working effect, and fluctuations of tension produced by the apparatus and method of the present invention have been found to greatly shorten the time required for a musical string to attain pitch stability. As the force required to stretch the string is reduced by the cold working effect and the force applied by the sliding movement is always parallel to the axis of the string, the stabilizing force is kept within parameters of instrument design.

While the present invention has been described with reference to guitar strings and guitars, it is to be recognized that the principles of the invention may be applied with equal advantage to banjos, mandolins, violins, pianos and other musical instruments wherein sound is produced by tensioned musical strings. Accordingly, the drawings and the foregoing description are not intended to represent the only form of the invention in regard to the details of construction and manner of use. Although specific terms have been employed herein, they are intended in an exemplary sense only and not for the purposes of limitation, the scope of the invention being delineated in the following claims.

The invention is claimed as follows:

1. A musical string tension stabilizer comprising a body portion and means forming a continuous curved frictioning channel in said body portion, said frictioning channel including an initial end section having means to retain a musical string in a bearing relationship against said body portion in a first direction, a mediate element having means to retain said musical string in a bearing relationship against said body portion in a direction opposite said first direction, and a terminal end section having means to retain said musical string in a bearing relationship against said body portion in said first direction.

2. A musical string tension stabilizer comprising an elongate body portion, at least one elongate wall defining said body portion, and means forming a continuous curved frictioning channel traversing the length of said wall, said frictioning channel including an initial end section having a lipped groove adapted to retain a musical string in a bearing relationship against an upper portion of said body in a first direction, a mediate element having a lipped groove adapted to retain said musical string in a bearing relationship against a lower portion of said body in a direction opposite the first direction, and a terminal end section having a lipped groove adapted to retain said musical string in a bearing relationship against an upper portion of said body in said first direction.

3. A musical string tension stabilizer according to claim 1 or claim 2 which further comprises means forming a handle attached to said elongated body portion.

4. A musical string tension stabilizer according to claim 1 or claim 2 which further comprises a handle portion spaced from said elongate body portion, said handle portion including end sections extending toward said elongate body portion and being connected thereto.

5. A method for stabilizing the tension of a musical string by the use of means defining a continuous curved frictioning channel, said means including an initial end section having means to retain a musical string in a bearing relationship against said body portion in a first direction, a mediate element having means to retain said musical string in a bearing relationship against said body portion in a direction opposite said first direction, and a terminal end portion having means to retain said musical string in a bearing relationship against said body portions in said first direction, the method comprising the steps of; placing a portion of said string in said frictioning channel and causing said first named means to traverse the length of said string to maximize the elongation and pitch stability thereof.

* * * * *